United States Patent [19]

Saito et al.

[11] 4,347,816

[45] Sep. 7, 1982

[54] FUEL/AIR MIXTURE SUPPLY SYSTEM WITH ADDITIONAL AIR SUPPLY

[75] Inventors: Masaaki Saito, Yokosuka; Yoshihisa Kawamura, Fujisawa; Yuko Sugo, Yokosuka; Mitsumasa Inoue, Yokohama, all of Japan

[73] Assignee: Nissan Motor Company, Limited, Yokohama, Japan

[21] Appl. No.: 104,702

[22] Filed: Dec. 17, 1979

[30] Foreign Application Priority Data

Dec. 28, 1978 [JP] Japan ..... 53-162549

[51] Int. Cl.[3] ..... F02B 15/00

[52] U.S. Cl. ..... 123/308; 123/432; 123/442

[58] Field of Search ..... 123/432, 308, 442

[56] References Cited

U.S. PATENT DOCUMENTS

| | | | |
|---|---|---|---|
| 3,171,395 | 3/1965 | Bartholomew . | |
| 3,678,905 | 7/1972 | Diehl | 123/432 |
| 3,916,860 | 11/1975 | Nakano et al. | 123/579 |
| 3,918,419 | 11/1975 | Dolza, Sr. | 123/432 |
| 4,086,885 | 5/1978 | Noguchi et al. . | |
| 4,108,124 | 8/1978 | Nakagawa et al. | 123/575 |
| 4,246,874 | 1/1981 | Nakagawa et al. | 123/308 |
| 4,261,795 | 6/1981 | Nakagawa et al. | 123/308 |
| 4,271,801 | 6/1981 | Yamakawa et al. | 123/432 |

FOREIGN PATENT DOCUMENTS

| | | |
|---|---|---|
| 2847692 | of 1980 | Fed. Rep. of Germany . |
| 1024649 | of 1953 | France . |
| 1472204 | 1/1967 | France . |
| 2373683 | 12/1977 | France . |
| 55-35120 | of 1980 | Japan . |
| 55-85524 | of 1980 | Japan . |
| 544048 | 3/1942 | United Kingdom . |
| 986331 | of 1965 | United Kingdom . |
| 1353231 | of 1974 | United Kingdom . |
| 1472565 | 5/1977 | United Kingdom . |
| 1489378 | 10/1977 | United Kingdom . |
| 1529830 | 10/1978 | United Kingdom . |

*Primary Examiner*—Charles J. Myhre
*Assistant Examiner*—E. Rollins Cross

[57] ABSTRACT

Disclosed is a fuel/air mixture supply system for an internal combustion engine of the single-point fuel injection type wherein, the intake manifold system is formed with a first fuel/air supply passage which inspires atmospheric air and which has fitted generally at a midpoint thereof a fuel injection valve which injects fuel into the inspired air. The fuel/air mixture then proceeds to a first set of branched passages, each one of which conducts the fuel/air mixture to a cylinder of the engine. Further, there is provided a second air supply passage which inspires atmospheric air and which branches into a second set of branched passages, each one of which conducts air to a cylinder of the engine. The first fuel/air supply passage is smaller than the second air supply passage, and the first set of branched passages are smaller than the second set of branched passages. The flow of air/fuel mixture in the first fuel-/air supply passage is controlled by a first throttle valve, and the flow of air in the second air supply passage and/or the second branched passages is controlled by a regulating means responsive to the operation of the first throttle valve, so as to be substantially zero when the first throttle valve is open an amount less than a certain predetermined amount, while, when the first throttle valve is opened greater than the certain predetermined amount, the flow is progressively increased.

12 Claims, 11 Drawing Figures

FUEL/AIR MIXTURE SUPPLY SYSTEM WITH ADDITIONAL AIR SUPPLY

BACKGROUND OF THE INVENTION

The present invention relates to an improved intake manifold, throttle, and injector structure for a multi-cylinder internal combustion engine of the so-called single injection point type.

It is well known to provide air/fuel mixture for an internal combustion engine by a single fuel injection valve which injects fuel into the intake manifold to be supplied to all the cylinders. Such an engine is commonly referred to as a single injection point type engine. The injection valve is mounted in the intake manifold at a point upstream of where it branches into individual pipes to serve the individual cylinders. Because of the varying characteristics of each of these individual pipes, they are individually sized so as to enable the engine to develop its maximum output power.

Accordingly, it is very difficult to make the best use of the inertia supercharging effect over the whole range of engine operational conditions. In the low load range, particularly, the air flow speed in the manifold is low, and the fuel is therefore not atomized properly. Thus so-called "wall flow" may occur; that is, droplets of fuel may collect on the wall of inlet the manifold. This may lead to slow engine response.

SUMMARY OF THE INVENTION

Therefore, it is an object of the present invention to provide an intake mixture supply system for an internal combustion engine of the single injection point type, which improves the atomization of fuel by increasing the air flow speed in the low load region. Another object is to provide such a supply system which increases the maximum output power available from the engine by utilizing the inertia supercharging effect to the full in high load conditions.

According to the present invention, these and other objects are accomplished by, in an internal combustion engine of the single-point fuel injection type, providing a plurality of power cylinders each with an inlet valve and an inlet port passage leading to the inlet valve; an inlet mixture supply system, comprising: (a) an air supply system, comprising: (a.1) a first intake passage, which takes in atmospheric air at its one end; (a.2) a plurality of first branch passages, one corresponding to each inlet port passage, each of which is connected at its one end to receive the air flow from the other end of the first intake passage, and each of which discharges air flow from its other end into its corresponding inlet port passage; (a.3) and means including a first throttle valve for controlling air flow, which controls flow of air through the air supply system; (b) a mixture supply system, comprising: (b.1) a second intake passage, which takes in atmospheric air at its one end; (b.2) a mixture throttle valve, which controls air flow in the second intake passage; (b.3) a fuel injection valve, disposed so as to inject fuel into a point of the second intake passage downstream of the mixture throttle valve; (b.4)and a plurality of second branch passages, one corresponding to each inlet port passage, each of which is connected at its one end to receive flow of air and injected fuel from the other end of the second intake passage, and each of which discharges air/fuel mixture flow from its other end into its corresponding inlet port passage; (c) and means for interrelating the operation of the mixture throttle valve and the air flow control means, which controls the air flow control means to pass substantially no air flow when the mixture intake valve is opened up to a certain predetermined opening, and which progressively controls the air flow control means to pass progressively more and more air flow through the air supply system as the mixture intake valve is further increased beyond said certain predetermined opening: (d) each second branch passage being of generally smaller cross-section than its corresponding first branch passage, and the second intake passage being of generally smaller cross-section than the first intake passage.

BRIEF DESCRIPTION OF THE DRAWINGS

The present invention will become more fully understood with reference to the following description of several preferred embodiments thereof, and with reference to the attached drawings, which, however, are not to be taken as limitative of the present invention in any way, but are given for the purposes of illustration and elucidation only. In the drawings.

DESCRIPTION OF THE PREFERRED EMBODIMENTS

Figure 1:
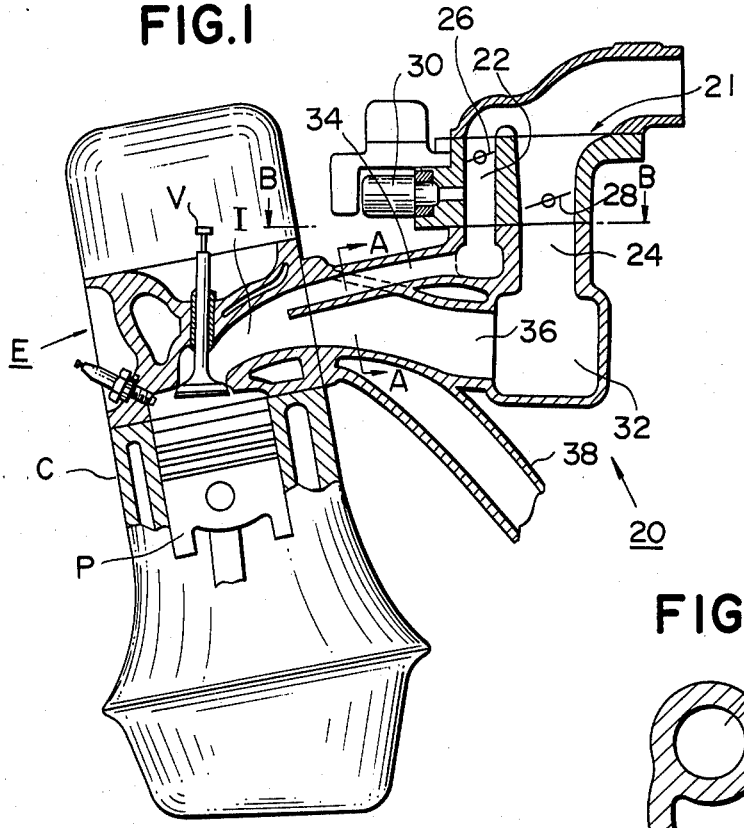
FIG. 1 is a sectional view of a preferred embodiment of an inlet mixture supply system according to the present invention.
Figure 2:
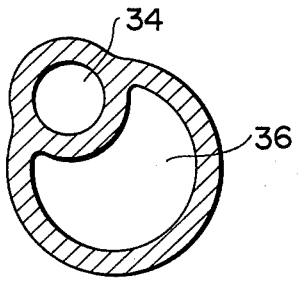
FIG. 2 is a cross-sectional view taken along the line A—A in FIG. 1.
Figure 3:
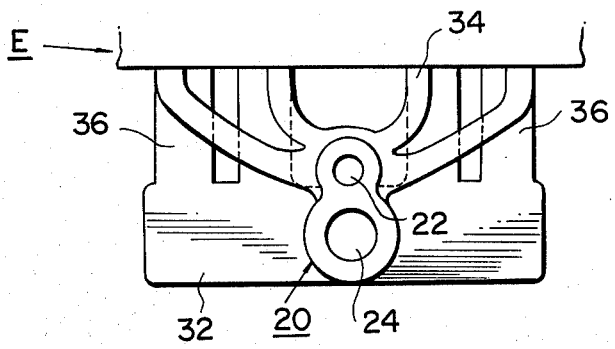
FIG. 3 is a cross-sectional view side view, taken along the line B—B in FIG. 1.

FIGS. 1, 2, and 3 show a first preferred embodiment of the present invention. A multicylinder internal combustion engine E comprising several cylinders C, of which one only is visible in FIG. 1, is provided with an intake manifold arrangement generally designated by 20, according to the present invention. Further, the cylinders C are fitted with pistons P, an exhaust manifold 38, inlet valves V, and inlet port passages I, all of a wellknown sort.

This engine is of the one-point fuel injection sort, and the fuel is injected by a fuel injector 30, which injects fuel into the inlet manifold structure.

An air inlet passage designated by reference numeral 21 divides into two passages of unequal size: a smaller passage 22 and a larger passage 24. Near their upper or inlet ends these passages are fitted with throttle valves 26 and 28, respectively. The fuel injector 30 is arranged to inject fuel into the smaller passage 22 below, or downstream of, the throttle valve 26. The two throttle valves 26 and 28 are interconnected by a linkage not shown in the drawing, so that when the accelerator pedal of the vehicle which is fitted with the engine is depressed, first the smaller throttle valve 26 is opened, up to a predetermined angle, and then the larger throttle valve 28 is opened progressively, at higher amounts of pedal depression. Thus the amount of intake air is controlled.

Alternatively, it would be quite within the scope of the present invention to control the opening and closing of the larger throttle valve 28 by a conventional vacuum type driving device such as a diaphragm device.

Downstream of the smaller throttle valve 26, the smaller passage 22 divides into a plurality of smaller branch passages 34, one for each cylinder of the engine. These extend at a generally downward slope, and each opens into an inlet port passage I leading to one of the cylinders C. Further, downstream of the larger throttle valve 28, the larger passage 24 opens into a buffer plenum 32, and from this buffer plenum 32 lead a plurality of larger branch passages 36, one for each cylinder of the engine. These larger branch passages 36 lead at a generally upward slope, and each opens into an inlet port passage I leading to one of the cylinders C, adjacent to the opening of the smaller branch passage 34 for that cylinder. In this embodiment, the smaller branch passages 34 terminate within the inlet port passage I, or substantially reach the corresponding inlet valves 3, respectively.

The smaller branch passages 34 are arranged to slope generally downwards in order that any fuel droplets which may be entrained on their walls may flow downwards quickly and easily to the cylinders. Further, the larger branch passages 36 are arranged to slope generally upwards, because they conduct only air, and so there are no considerations of fuel droplets entrained on the walls of the passages 36. This complimentary arranged configuration of the smaller and larger branch passages 34 and 36 is convenient to lay out and manufacture, and is compact.

In order to increase low-speed torque, by the principle of inertia supercharging, and also to promote atomization of fuel during the passage of fuel-air mixture along the smaller branch passages 34, these passages are preferably long. Further, it is preferable to dispose the outlets of the smaller branch passages 34 eccentrically to the axes of the inlet port passages I, so that swirling may be imparted to the flow of air and fuel as it enters the cylinders C, in order to promote good mixing thereof, and increase combustion efficiency.

Further, it is preferable that the smaller branch passages 34 should open quite deep in the inlet port passages I, so as to minimize the risk of reverse flow of air/fuel mixture back from the openings of these smaller branch passages 34 into the larger branch passages 36.

This system operates as follows. When the engine load is low, and a smaller amount of intake mixture is required, only the smaller throttle 26 is opened, and air is taken in only through the smaller passage 22. This air, after fuel is injected into it by the fuel injector 30, is divided and supplied to the cylinders C, through the smaller branch passages 34. Because of the relatively smaller cross-sectional area of the passages 22 and 34, the speed of the air flow is relatively high, and thereby the injected fuel is well atomized and vaporized before it is taken past the valves V into the cylinders C.

When however the engine load rises, the larger throttle 28 starts to open, and then air is also drawn past this throttle 28, into the buffer plenum 32, and thence through the larger branch passages 36 into the cylinders C past the valves V, mixing in the inlet port passages I with the air/fuel mixture which is coming from the outlets of the smaller branch passages 34. Because of the high flow speed in these passages 34, the air/fuel mixture is already well atomized and vaporized, and therefore it mixes easily and quickly with the air coming through the larger branch passages 36.

The larger branch passages 36 are constructed in a similar manner to branch passages of an inlet manifold of a conventional port-injection type internal combustion engine, because fuel injection is not effected within these larger branch passages, and they are carrying only air. This promotes good air intake efficiency and inertia supercharging effect, when the amount of intake air flow is relatively large, and thereby a large amount of air/fuel mixture may be taken into the cylinders when the engine is to be operated at high power output. Thereby maximum output power of the engine is increased.

Figure 4:
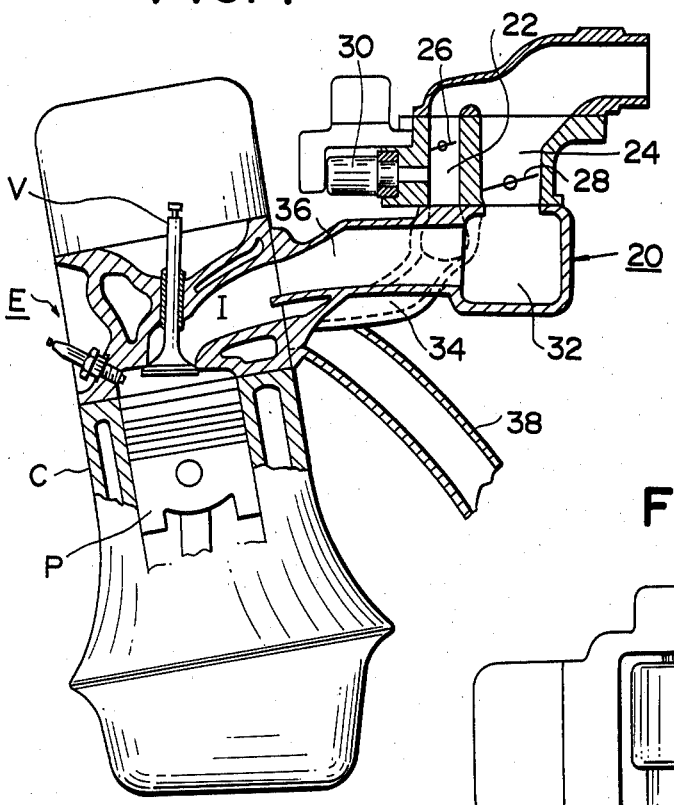
FIG. 4 is a view, similar to FIG. 1, of a second embodiment of the present invention.

FIG. 4 shows a second embodiment of the intake manifold structure according to the present invention, in which each of the smaller branch passages 34 runs generally lower than its corresponding larger branch passage 36, and the openings of the branch passages 34 are located in a lower part of the inlet port passages I. Thus it is positively prohibited for fuel droplets flowing off the walls of the smaller branch passages 34 to flow into the larger branch passages 36. Further, the smaller branch passages 34 carrying air/fuel mixture are passed close to the exhaust manifold 38, so that they are more conveniently warmed, optionally by some sort of hot spot arrangement not shown in the figures, in order to further vaporize the fuel.

Figure 5:
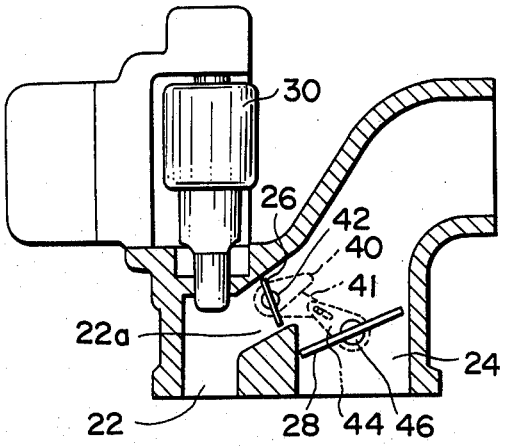
FIG. 5 is a cross-sectional view of a modification of the fuel injecting arrangements of the inlet mixture supply system according to the present invention.

FIG. 5 shows a modification of the throttle arrangement. In this layout, the smaller passage 22 is provided as a main passage 22 and an inclined passage portion 22*a* at the upstream end of the main passage 22 at an angle thereto. The throttle valve 26 is provided in the inclined passage portion 22*a*, and the fuel injection valve 30 is provided at the joining portion between the inclined passage portion 22*a* and the main passage 22, so that fuel squirted out of it is directed along and downstream of the main passage 22, so as to be more easily entrained into the air flow, thereby improving distribution and atomization of the fuel. In this particular embodiment, a form of interlock between the smaller throttle valve 26 and the larger throttle valve 28 is shown. The smaller throttle valve 26 is mounted on the smaller throttle valve shaft 42, which has a first lever 40 mounted fixedly thereon and has a second lever 41 mounted thereon so as to be freely rotatable. Further, the larger throttle valve 28 is mounted on the larger throttle valve shaft 46, and to this larger throttle valve shaft 46 is mounted fixedly the third lever 44. When the smaller throttle valve 26 is first opened, these levers 40 and 44 do not engage, and the larger throttle valve 28 is not opened; but, when the smaller throttle valve 26 is opened past a certain predetermined intermediate position (about 50°), then the first lever 40 engages the second lever 41, and then progressively rotate the third lever 44, to open the larger throttle valve 28.

Figure 6:
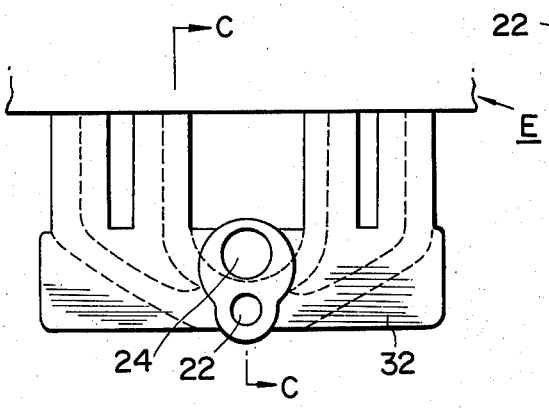
FIG. 6 is a view, similar to FIG. 3, of a third embodiment of the present invention.
Figure 7:
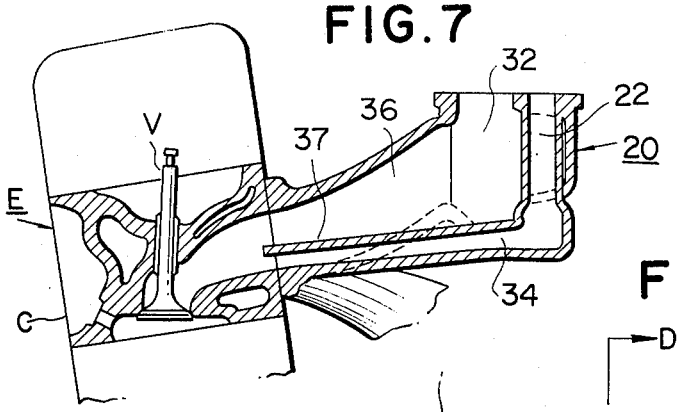
FIG. 7 is a cross-sectional view taken along the line C—C in FIG. 6.

FIGS. 6 and 7 show a third embodiment of the present invention. Whereas in the embodiment of FIG. 4 the passages 34 crossed between or through (optionally) the passages 36, in this third embodiment, on the other hand, the passages 34 are always on the same side of the passages 36, which is the lower/right side in the figures. Thereby, it is possible to form all these passages out of one casting, with the passages 34 being separated from the passages 36 by a mere partition 37. Further, the advantageous heating effect from the exhaust pipe is increased.

Figure 8:
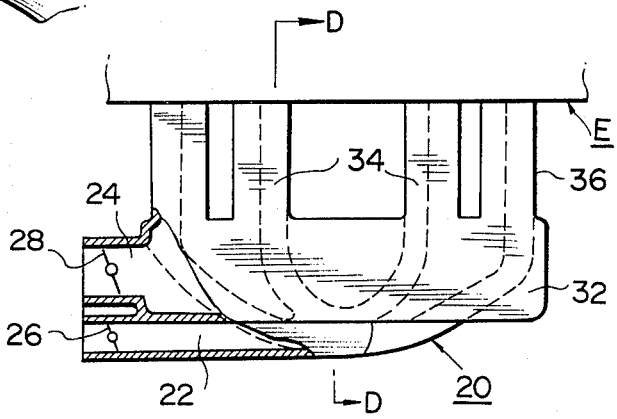
FIG. 8 is a partially cross-sectional view, similar to FIGS. 3 and 6, of a fourth embodiment of the present invention.
Figure 9:
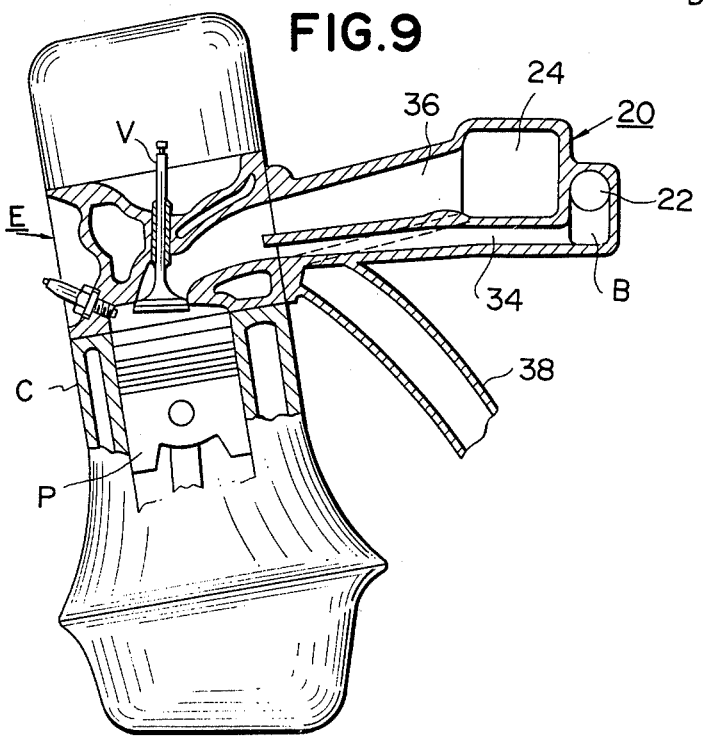
FIG. 9 is a cross-sectional view taken along the line D—D in FIG. 8.

FIGS. 8 and 9 show a fourth embodiment of the present invention. In this structure, the passages 22 and 24 extend sideways, and the passage 24 is cranked downwards at B through a right angle where it branches to form the smaller branch passages 34. This arrangement co-operates with the small cross-sectional area of the branch passages 34, so as to ensure equal distrubtion of fuel/air mixture to the various individual cylinders. Such a manifold can provide a layout which is similar to that of a conventional port-injection internal combustion engine.

Figure 10:
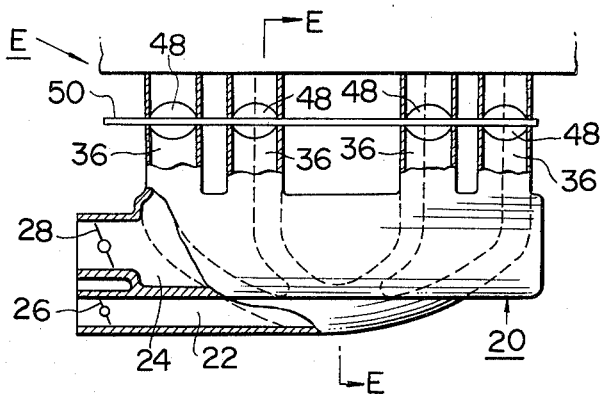
FIG. 10 is a partially cross-sectional view, similar to FIGS. 3, 6, and 8, of a fifth embodiment of the present invention.
Figure 11:
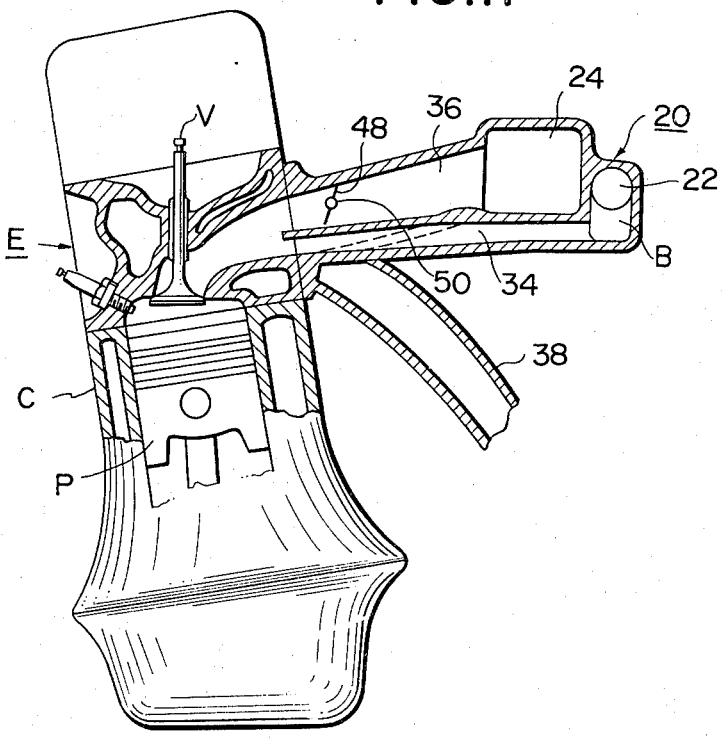
FIG. 11 is a cross-sectional view taken along the line E—E in FIG. 10.

Finally, FIGS. 10 and 11 show a fifth embodiment of the present invention, whose layout is similar to that of the fourth embodiment of FIGS. 8 and 9, except that individual throttle valve 48 are provided in the larger branch passages 36 near their downstream ends. These throttle valves 48 may be all rotated together by a common throttle valve shaft 50. Thus, when only the smaller throttle valve 26 in the smaller passage 22 is open, the closing of a throttle valve 48 in the corresponding larger branch passage 36 serves to prevent the air/fuel mixture from flowing round from the corresponding smaller branch passage 34 through part of the inlet port passage of the corresponding engine cylinder and through the corresponding larger branch passage 35 into other cylinders than the corresponding one. Thus variations of distribution of air between the various cylinders, which might cause undesirable fluctuation of air/fuel ratio between the cylinders, are prevented. In this embodiment, the throttle valve 28 may optionally be omitted. If not, however, of course it is rotated in unison with the throttle valves 48, which are in any case rotated to provide control of air flow through the total air flow system as provided in the other embodiments.

Provision of throttles 26 and 28 within air intake passages 22 and 24, respectively, serves to increase the accuracy of ignition timing and of a vacuum pressure extracted for controlling exhaust gas recirculation.

Although the present invention has been shown and described with reference to several preferred embodiments, it should not be considered as limited to these, however, or mere and simple generalizations, or other detailed embodiments. Yet further modifications to the form and the content of any particular embodiment could be made, without departing from the scope of the present invention, which it is therefore desired should be defined not by any of the purely fortuitous details of the shown embodiments, or of the drawings, but solely by the appended claims.

We claim:

1. In an internal combustion engine of the single-point fuel injection type, comprising a plurality of power cylinders each provided with an inlet valve and an inlet port passage leading to the inlet valve;

(a) an air suply system, comprising:

(a.1) a first intake passage having first and second ends and which takes in air at said first end:

(a.2) a plurality of first branch passages, one corresponding to each inlet port passage, each of which is connected at one end to receive the air from the second end of the first intake passage, and each of which discharges air from its other end into a corresponding inlet ort passage;

(a.3) and means including a first throttle valve disposed in said first end of said first intake passage and mounted on a first shaft for controlling air flow, which controls flow of air through the air supply system;

(b) a mixture supply system, comprising:

(b.1) a second intake passage, having an inclined end opening close to the first end of the first intake passage for taking in air at said inclined end;

(b.2) a mixture throttle valve mounted on a second shaft and disposed in said inclined end for controlling air flow in the second intake passage;

(b.3) a fuel injection valve, disposed adjacent the inclined end of the second passage so as to inject fuel in a direction in which the second passage extends into a point of the second intake passage downstream of the mixture throttle valve;

(b.4) and a plurality of second branch passages each having first and second passage ends, one of said second branch passages corresponding to each inlet port passage, each of said second branch passages being connected at said first passage end to receive a flow of air and injected fuel from an other end of the second intake passage, and each of which discharges an air/fuel mixture from said second passage end into a corresponding inlet port passage;

(c) and means for interrelating the operation of the mixture throttle valve and the means for controlling the air flow to pass substantially no air flow when the mixture throttle valve is opened up to a certain predetermined opening, and which progressively controls the means for controlling the air flow to pass progressively more and more air through the air supply system as the mixture throttle valve opening is further increased beyond said certain predetermined opening, said interrelating means including a first lever mounted fixedly on said second shaft, coupling means including a second lever mounted on said second shaft, and a third lever mounted on said first shaft, wherein when the mixture throttle valve is first rotated to open, the first throttle valve is not rotated and remains closed, but when the mixture throttle valve is rotated to open past a certain intermediate position, said first throttle valve rotates to an open position;

(d) each second branch passage being of generally smaller cross-section than its corresponding first branch passage, and the second intake passage being of generally smaller cross-section than the first intake passage.

2. In an internal combustion engine of the single-point fuel injection type, comprising a plurality of power cylinders each provided with an inlet valve and an inlet port passage leading to the inlet valve; an inlet mixture supply system, comprising:

(a) an air supply system, comprising:

(a.1) a first intake passage having first and second ends and which takes in air at said first end;

(a.2) a plurality of first branch passages, one corresponding to each inlet port passage, each of which is connected at one end to receive the air from the second end of the first intake passage, and each of which discharges air from its other end into a corresponding inlet port passage;

(a.3) and means, including a first throttle valve mounted on a first shaft, for controlling air flow, which controls flow of air through the air supply system;

(b) a mixture supply system, comprising:

(b.1) a second intake passage, which takes in atmospheric air at one end;

(b.2) a mixture throttle valve mounted on a second shaft and, which controls air flow in the second intake passage;

(b.3) a fuel injection valve, disposed so as to inject fuel into a point of the second intake passage downstream of the mixture throttle valve;

(b.4) and a plurality of second branch passages, each having first and second passage ends one of said second branch passages corresponding to each inlet port passage, each of said second branch passages being connected at said first passage end to receive a flow of air and injected fuel from an other end of the second intake passage, and each of which discharges an air/fuel mixture from said second passage end into a corresponding inlet port passage;

(c) and means for interrelating the operation of the mixture throttle valve and means for controlling the air flow to pass substantially no air flow when the mixture intake valve is opened up to a certain predetermined opening, and which progressively controls the air flow control means to pass progressively more and more air through the air supply system as the mixture intake valve is further increased beyond said certain predetermined opening, said interrelating means including a first lever mounted fixedly on said second shaft, coupling means including a second lever mounted on said second shaft, and a third lever mounted on said first shaft, wherein when the mixture throttle valve is first rotated to open, the first throttle valve is not rotated and remains closed, but when the mixture throttle valve is rotated to open past a certain intermediate position, said first throttle valve rotates to an open position;

(d) each second branch passage being of generally smaller cross-section than its corresponding first branch passage, and the second intake passage being of generally small cross-section than the first intake passage.

3. An inlet mixture supply system as in claim 1 or claim 2, wherein the air supply system further comprises a buffer plenum which is connected between said second end of the first intake passage and said one ends of the first branch passages, and which has a comparatively large capacity so that it smooths fluctuations in air flow through the air supply system.

4. An inlet mixture supply system as in claim 1 or claim 2, wherein the first branch passages and the second branch passages are formed integrally with one another.

5. An inlet mixture supply system as in claim 1 or claim 2, wherein the first intake passage is formed with a sharp bend therein.

6. An inlet mixture supply system as in claim 1 or claim 2, wherein the first branch passages generally extend upwardly sloping from their said one ends to their said other ends, and wherein the second branch passages generally extend downwardly sloping from their first passage ends to their second passage ends.

7. An inlet mixture supply system as in claim 1 or claim 2, wherein the first and second intake passages extend generally in a sidewise direction along the line of the cylinders of the engine.

8. An inlet mixture supply system as in claim 1 or claim 2, wherein the second branch passages each discharges air/fuel mixture at an eccentric position in its corresponding inlet port passage.

9. An inlet mixture supply system as in claim 1 or claim 2, wherein each of the second branch passages discharges its air/fuel mixture at a position somewhat inside of the entrance to its corresponding inlet port passage.

10. An inlet mixture supply system as in claim 1, wherein the air flow control means comprises a plurality of individual throttle valves, one located in each of the first branch passages, which are operated in unison.

11. An inlet mixture supply system as in claim 10, wherein the air flow control means further comprises a throttle valve in the first intake passage which is operated in unison with the individual throttle valves.

12. An inlet mixture supply system as in claim 1, wherein the second intake passage is formed with a bend, and wherein the fuel injection valve injects fuel just downstream of the bend approximately directly downstream along the second intake passage.

* * * * *